US005829071A

United States Patent [19]

Lavalle

[11] Patent Number: 5,829,071

[45] Date of Patent: Nov. 3, 1998

[54] TILE SHIELDS AND DISPOSABLE BATH LINER

[76] Inventor: Damali Lavalle, 144-45 229 St., Rosedale, N.Y. 11413

[21] Appl. No.: 859,118

[22] Filed: May 16, 1997

[51] Int. Cl.[6] ..... A47K 3/02

[52] U.S. Cl. ..... 4/580; 4/559; 4/605

[58] Field of Search ..... 4/580, 584, 559, 4/581, 582, 583, 596, 597, 605, 609, 612

[56] References Cited

U.S. PATENT DOCUMENTS

| | | | |
|---|---|---|---|
| 4,067,071 | 1/1978 | Altman et al. | 4/580 |
| 4,299,064 | 11/1981 | Daniels | 4/580 |
| 4,671,026 | 6/1987 | Wissinger | 52/35 |
| 5,003,647 | 4/1991 | Williams | 4/559 |
| 5,435,021 | 7/1995 | Williams | 4/580 |

*Primary Examiner*—David J. Walczak
*Attorney, Agent, or Firm*—Harvey Lunenfeld

[57] ABSTRACT

An inexpensive, attractive, easy to install, disposable bath liner and tile shield that prevents water from contacting walls and infiltrating behind walls and into a building structure, which may be removably attached to bath walls. The disposable bath liner has a side panel and opposing end panels for covering and protecting a side wall and opposing end walls of a bath enclosure, is flexible, capable of being removably attached to the bath walls, may be transparent or opaque, depending upon a user's needs, and of a material that may be imprinted with a decorative design. The disposable bath liner is also durable and light weight, easily fits irregularly shaped walls and a variety of bath enclosure sizes, is fabricated from materials that do not corrode, rust, bleed onto, and/or soil bath walls, is installable as a retrofit to existing baths, and has cut outs for bath fixtures to fit therethrough.

20 Claims, 16 Drawing Sheets

TILE SHIELDS AND DISPOSABLE BATH LINER

BACKGROUND OF THE INVENTION

1. Field of the Invention

The present invention relates generally to bath protectors and more particularly to disposable bath liners.

2. Background Art

Although water is a source of life, water also has a destructive force that has ravaged structures built by mankind for centuries. From the time of the Roman Baths to the present time, the repetitive action of water on bath and shower walls has eroded and damaged walls, surfaces, and associated structures. In certain instances, chemical slime may build up on shower and bath walls, depending upon the composition of soap and other chemicals used for bathing.

In the case of tile bath and shower walls, grout, which is generally placed between such tiles, may be eroded and/or washed away, leaving crevices and spaces for water to leak and seep through and damage structures behind and surrounding such baths. Damage from water seepage and leakage may often go undetected, especially from hair line cracks, until there is significant water build up between walls, floors, and ceilings below the baths. Such water leakage, seepage, and water build up may eventually cause the tiles to lift off supporting surfaces and/or damage adjoining walls and ceilings beneath baths and showers, which may rot and/or cave in.

Repairs to damaged structures may be expensive, in comparison to a much needed inexpensive means for protecting bath and shower walls and surfaces. Maintenance for cleaning slime build up from shower and bath walls may also be excessive and time consuming, in comparison to simple, inexpensive protection of shower and bath walls from such slime build up.

Inserting a barrier as an interface between bath water and bath and shower wall surfaces, to prevent water from contacting bath and shower walls, will act to eliminate damage from water leakage and seepage between tiles and slime build up on bath walls and tiles.

There is a need for an inexpensive, attractive, easy to install, disposable bath liner and tile shield that prevents water from contacting walls and infiltrating behind walls and into a building structure, which may be removably attached to bath walls. The disposable bath liner should be durable and light weight, easily fit irregularly shaped walls and a variety of bath enclosure sizes, be fabricated from materials that do not corrode, rust, bleed onto, and/or soil bath walls, and be installable as a retrofit to existing baths. The disposable bath liner should also be flexible, capable of being removably attached to the bath walls, transparent or opaque, depending upon a user's needs, and of a material that may be imprinted with a decorative design.

Different bath and shower protectors have heretofore been known. However, none of the bath and shower protectors adequately satisfies these aforementioned needs.

Different bath and shower protectors have been disclosed.

U.S. Pat. No. 4,671,026 (Wissinger) discloses a bathtub wall surround kit to be secured to walls of a bathtub opening and seals therefor. The kit includes a pair of end panels that are adapted to be secured to end walls of a bathtub opening and a pair of side panels adapted to be secured to a side wall of the bathtub opening. The pair of end panels and the pair of side panels are all of approximately uniform dimension for compact nesting during shipment. The kit also includes vertical seals for joining confronting edges of the end panels and the side panels. Corner seals are provided to join a portion of the bottom edges of the end panels and the lower side panel adjacent the confronting edges to the rim of the bathtub. With this arrangement, the bathtub wall surround kit and seals therefor eliminate the need for caulking joints during and after installation.

U.S. Pat. No. 5,003,647 (Williams) discloses a magnetic fastening device for releasably attaching a shower liner to a shower wall comprising a wall mounting member having a back flat portion adapted for attachment to a shower wall. The mounting member has a node or hook directed away from the member into the shower area and an upper front portion sloping toward the rear of the member and in the direction of the shower wall. An unmounted member mates with the wall mounting member and has an aperture to receive the protruding node or hook on the wall mounting member. The unmounted member has an upper portion sloping toward the shower wall for mating with the mounting member. The wall mounting member and unmounted members are magnetically attracted one to the other. A kit that can be made comprising the magnetic fastening device with a shower liner.

For the foregoing reasons, there is a need for an inexpensive, attractive, easy to install, disposable bath liner and tile shield that prevents water from contacting walls and infiltrating behind walls and into a building structure, which may be removably attached to bath walls. The disposable bath liner should be flexible, capable of being removably attached to the bath walls, transparent or opaque, depending upon a user's needs, and of a material that may be imprinted with a decorative design. The disposable bath liner should also be durable and light weight, easily fit irregularly shaped walls and a variety of bath enclosure sizes, be fabricated from materials that do not corrode, rust, bleed onto, and/or soil bath walls, and installable as a retrofit to existing baths.

SUMMARY

The present invention is directed to an inexpensive, attractive, easy to install, disposable bath liner and tile shield that prevents water from contacting walls and infiltrating behind walls and into a building structure, which may be removably attached to bath walls. The disposable bath liner is flexible, capable of being removably attached to the bath walls, may be transparent or opaque, depending upon a user's needs, and of a material that may be imprinted with a decorative design. The disposable bath liner is also durable and light weight, easily fits irregularly shaped walls and a variety of bath enclosure sizes, is fabricated from materials that do not corrode, rust, bleed onto, and/or soil bath walls, and is installable as a retrofit to existing baths.

A disposable bath liner having features of the present invention comprises: a side panel and opposing end panels for covering and protecting a side wall and opposing end walls of a bath enclosure, respectively, wherein further the side walls and the opposing end walls define opposing wall corners; at least portions of the side panel and at least portions of the opposing end panels having means for adhering the portions of the side panel and the portions of the opposing end panels to the side wall and the opposing end walls, respectively; the side panels having opposing edge corners at the opposing wall corners; one of the end panels having an edge corner at one of the wall corners and the other end panel having an edge corner at the other opposing wall corner; one of the opposing edge corners of the side panel for mating with one of the edge corners of one of the end panels at one of the wall corners and the other opposing edge corner of the side panel for mating with the edge corner of the other end panel at the other wall corner; the side panel opposing edge corners and each of the end panel edge corners having adhesive means for adhering each of the end panel edge corners to the respective opposing side panel edge corner, one to the other; the side panel having a cut out for a bath fixture to fit therethrough; and at least one of the opposing end panels having a cut out for another bath fixture to fit therethrough.

DRAWINGS

These and other features, aspects, and advantages of the present invention will become better understood with regard to the following description, appended claims, and accompanying drawings where:

DESCRIPTION

The preferred embodiments of the present invention will be described with reference to FIGS. 1–21 of the drawings. Identical elements in the various figures are identified with the same reference numbers.

Figure 1:
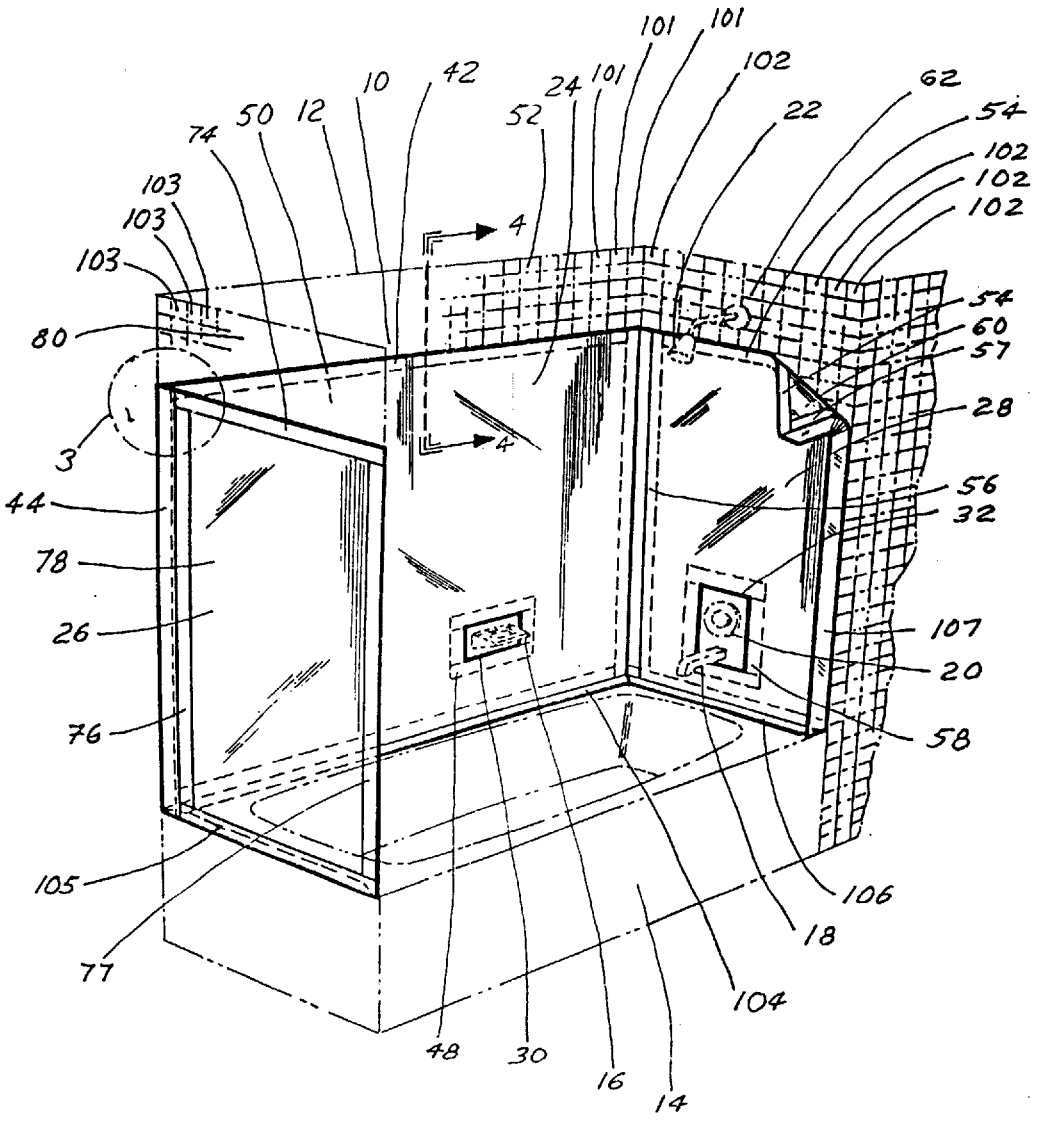
FIG. 1 is a perspective view of a disposable bath liner, constructed in accordance with the present invention.
Figure 2:
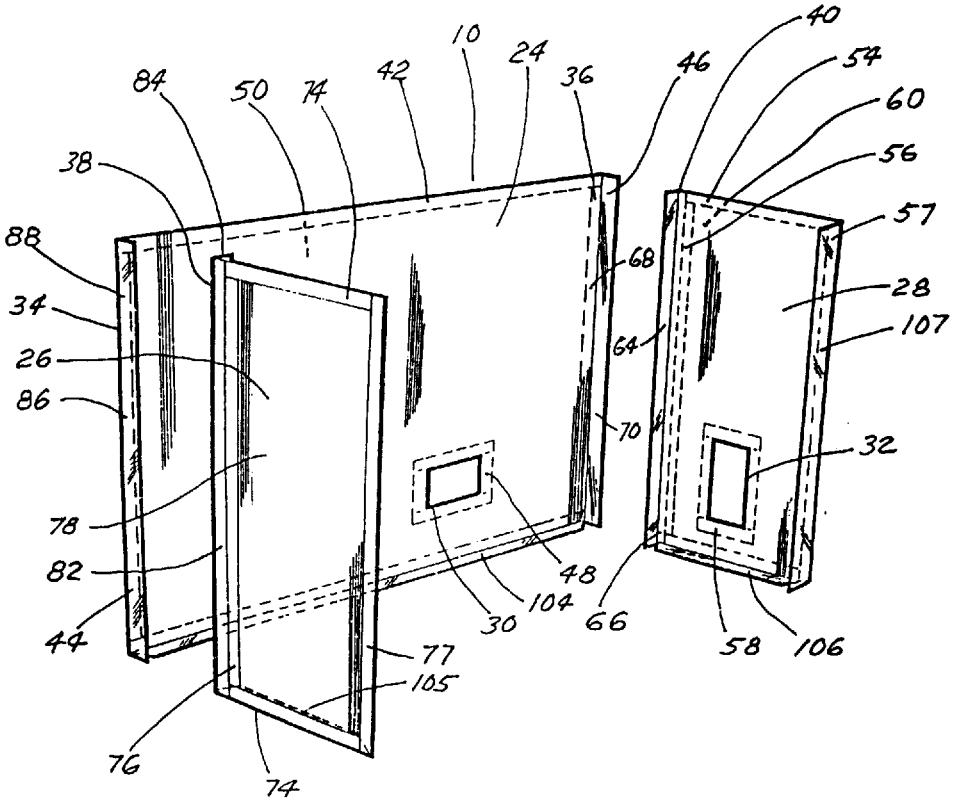
FIG. 2 is a perspective view of a side panel and opposing end panels of the disposable bath liner of FIG. 1.

FIGS. 1–5 show an embodiment of the present invention, a disposable bath liner 10, constructed in accordance with the present invention and installed in a typical bath enclosure 12 with tub 14, soap dish 16, tub spout 18, faucet control 20, and shower head 22. FIG. 2 shows a side panel 24 and opposing end panels 26 and 28 of the disposable bath liner 10. The side panel 24 has a cut out 30 for allowing the soap dish 16 to protrude therethrough, and one of the opposing end panels 28 has a cut out 32 for allowing the tub spout 18 and the faucet control 20 to protrude therethrough. The side panel 24 has opposing end corners 34 and 36 for confronting and conformally mating with corner 38 of the end panel 26 and with corner 40 of the end panel 28, respectively.

Top border 42, edges 44 and 46, and cut out border 48 of surface 50 of the side panel 24 facing wall 52 of the bath enclosure 12 are adhesively coated for adherence to the wall 52 upon installation. Top border 54, strip 56, side border 57, and cut out border 58 of side 60 of the end panel 28 facing wall 62 of the bath enclosure 12 are adhesively coated for adherence to the wall 62 upon installation. Corner edges 64 and 66 are adhesively coated for adherence to confrontingly mating surfaces 68 and 70 of the side panel 24 facing away from the wall 52. Top border 74, strip 76, and side border 77 of surface 78 of the end panel 26 facing wall 80 of the bath enclosure 12 are adhesively coated for adherence to the wall 80 upon installation. Corner edges 82 and 84 of the end panel 26 are adhesively coated for adherence to confrontingly mating surfaces 86 and 88 of the side panel 24 facing away from the wall 52 and the wall 80.

Figure 3:
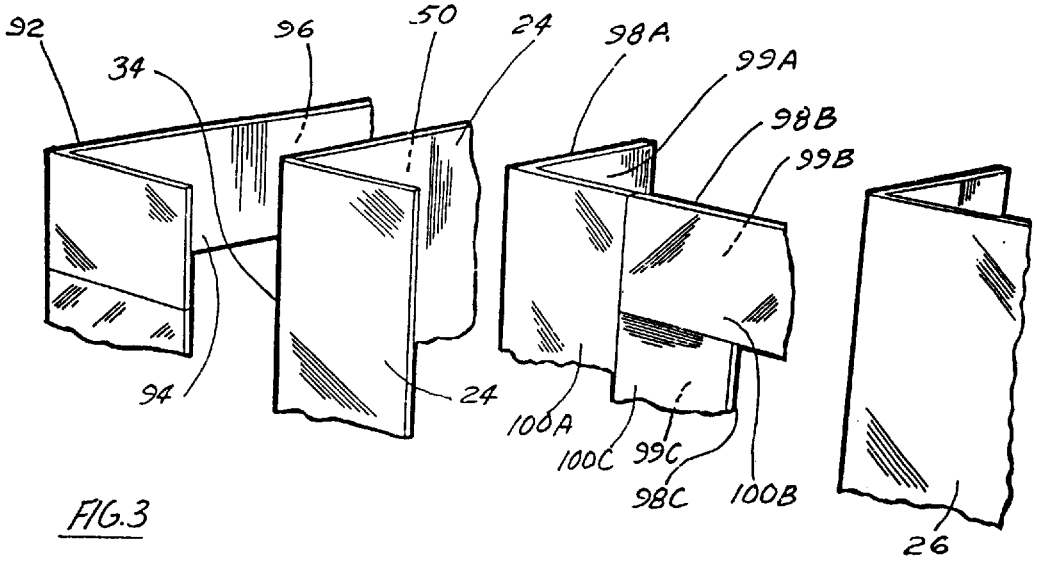
FIG. 3 is a perspective break out view of a corner of the disposable bath liner of FIG. 1.
Figure 4:
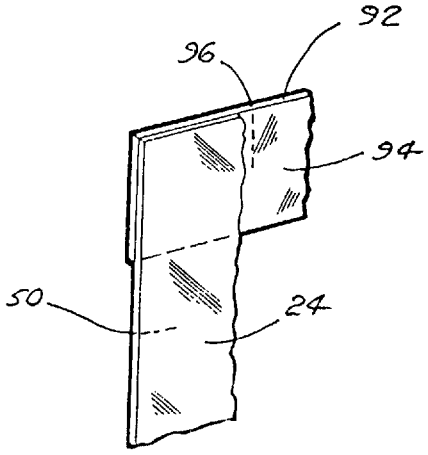
FIG. 4 is a perspective break out view of a section of the side panel of the disposable bath liner of FIG. 1.
Figure 5:
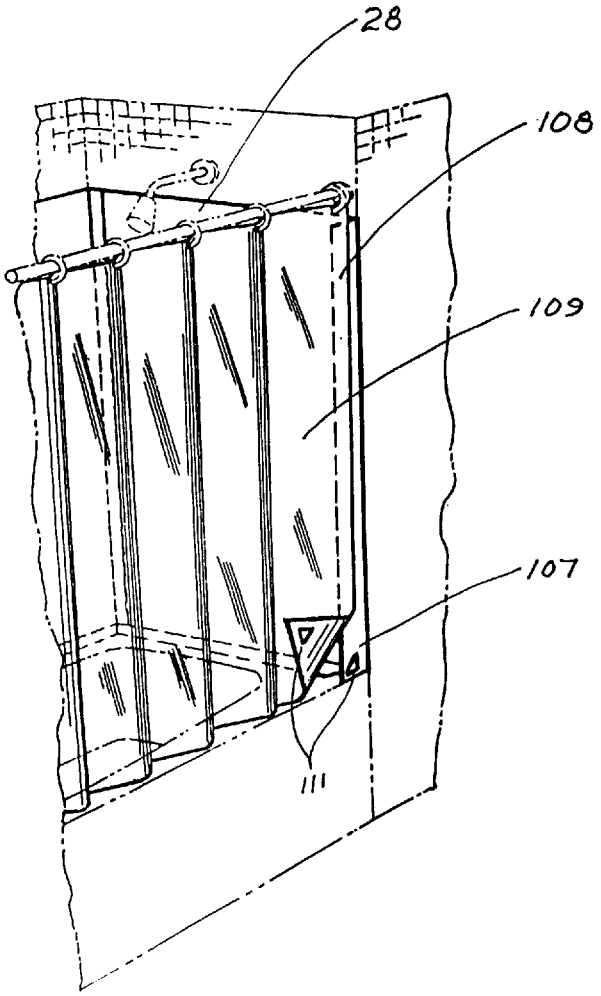
FIG. 5 is a perspective view of an optional shower curtain having a border adhered to a flap of the disposable bath liner of FIG. 1.
Figure 6:
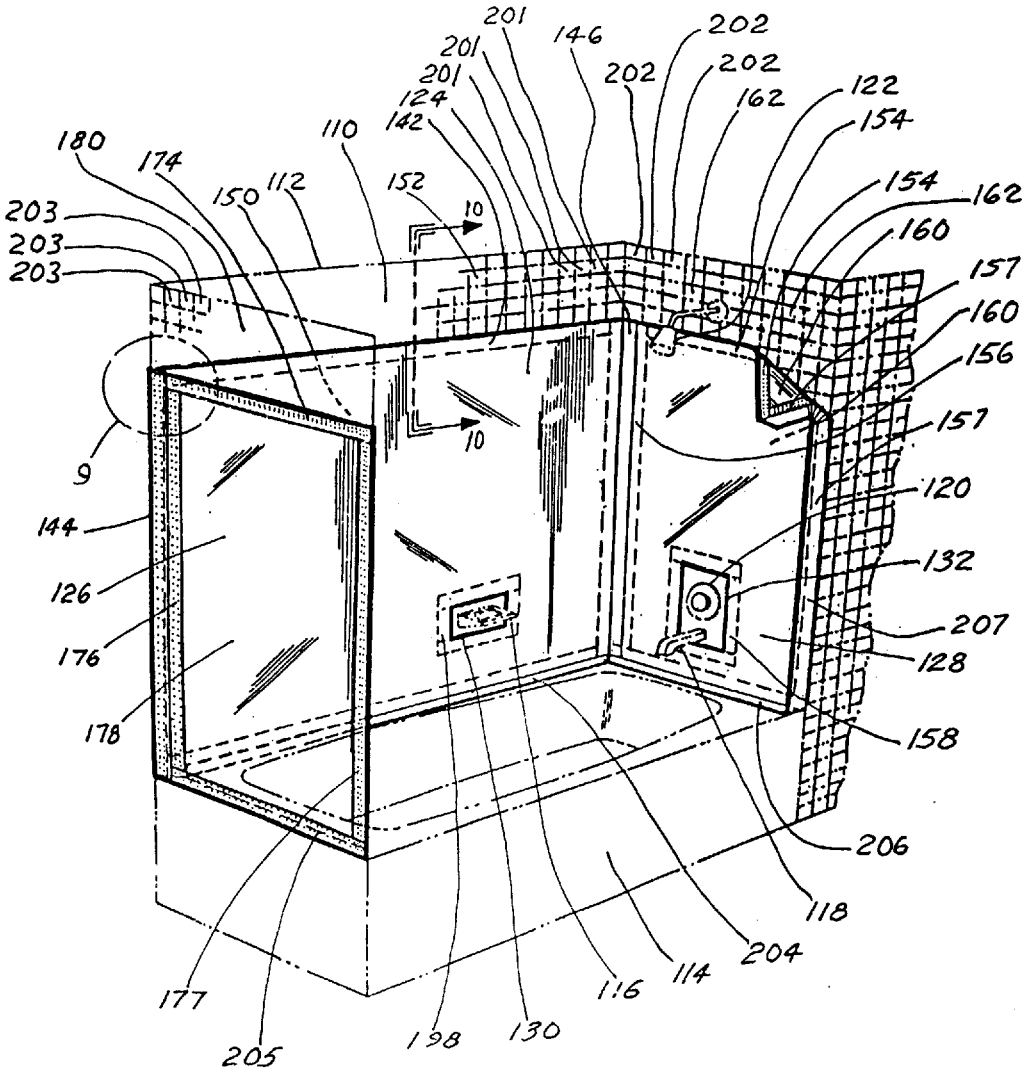
FIG. 6 is a perspective view of an alternate embodiment of a disposable bath liner, constructed in accordance with the present invention.

Adhesive coatings on the side panel 24 and the opposing end panels 26 and 28 are each water proof adhesives capable of withstanding repeated water use and temperature extremes customarily associated with routing and repeated bath use. Each of the adhesive coatings may be covered with tape for storing, shipping, and prior to installation. The tape would be removed from the side panel 24 and the opposing end panels 26 and 28 to expose the adhesive coatings for adherence to the walls 52, 62, and 80 at the time of installation. As shown in FIGS. 3 and 4, adhesive coatings may alternatively be incorporated onto the side panel 24, using double sided adhesive tape 92, of which one side 94 is adhered to the surface 50 of the side panel 24 and opposing side 96 of the adhesive tape 92 is adhered to the wall 52. Double sided adhesive tape 98A, 98B, and 98C may also be adhered to the opposing end 20 panels 26 and 28, of which surfaces 99A, 99B, and 99C, respectively are adhered to the end panels 26 and 28 and opposing surface 100A is adhered to the side panel 24 and opposing surfaces 100B and 100C to the walls 80 and 62.

The side panel 24 and the opposing end panels 26 and 28 are of PVC or other suitable flexible material, which may be clear transparent, tinted, colored transparent, translucent, opaque, or patterned material to allow a user personal choice for use and appearance, while protecting the walls 52, 62, and 80 and associated tiles 101, 102, and 103. The cut outs 30 and 32 may be optionally located, cut out, and trimmed during installation to allow for variations in locations and sizes of the soap dish 16, the tub spout 18, and the faucet control 20 in the bath enclosure 12.

Bottom edges 104, 105, and 106 of the side panel 24 and the end panels 26 and 28, respectively overlap the tub 14. An optional flap 107 is provided on the end panel 28 for adherence to border 108 of optional shower curtain 109, shown in FIG. 5. The optional flap 107 may be adhesively coated for adherence to the border 108 of the optional shower curtain 109, or the optional flap 107 and the border 108 of the optional shower curtain 109 may have interlocking hook and loop fasteners 111 for adjoining each thereto the other.

Figure 7:
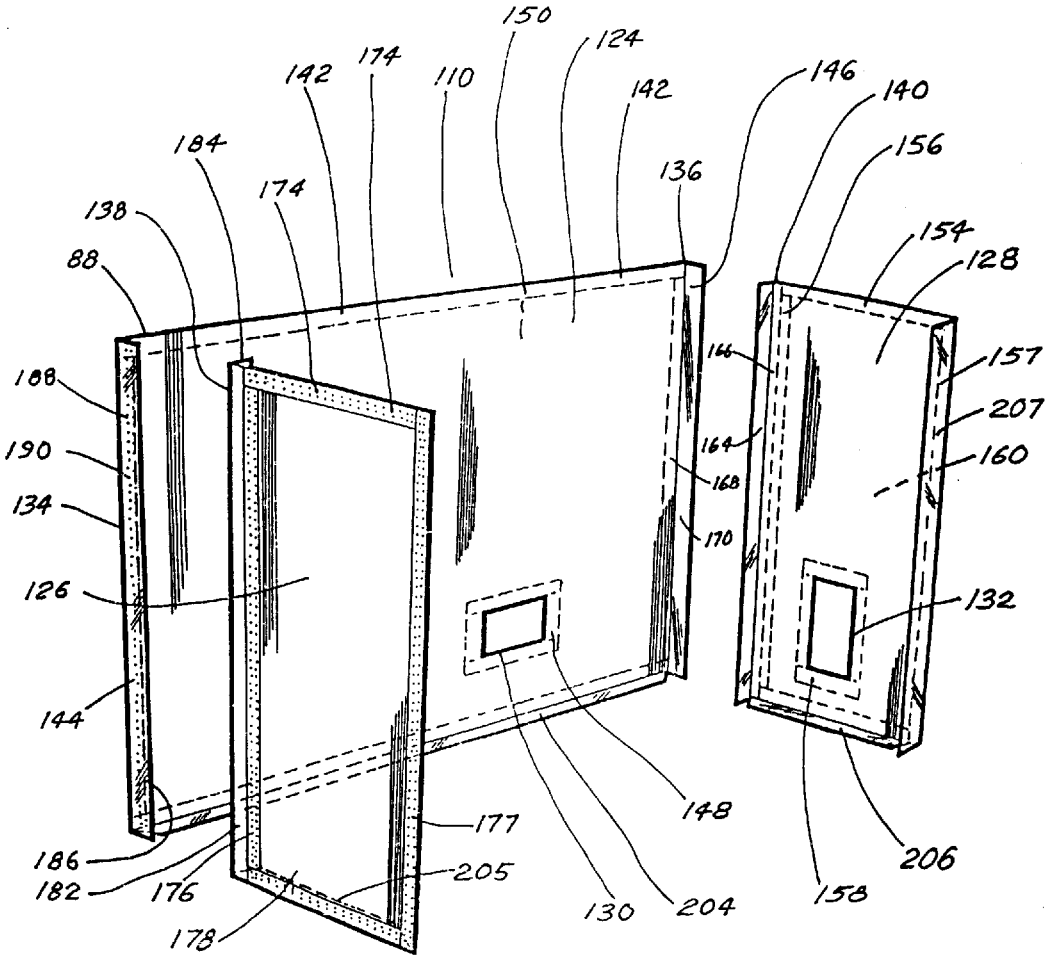
FIG. 7 is a perspective view of a side panel and opposing end panels of the disposable bath liner of FIG. 6.

FIGS. 6–11 show an alternate embodiment of the present invention, a disposable bath liner 110, constructed in accordance with the present invention and installed in a typical bath enclosure 112 with tub 114, soap dish 116, tub spout 118, faucet control 120, and shower head 122. FIG. 7 shows a side panel 124 and opposing end panels 126 and 128 of the disposable bath liner 110. The side panel 124 has a cut out 130 for allowing the soap dish 116 to protrude therethrough, and one of the opposing end panels 128 has a cut out 132 for allowing the tub spout 118 and the faucet control 120 to protrude therethrough. The side panel 124 has opposing end corners 134 and 136 for confronting and conformally mating with corner 138 of the end panel 126 and with corner 140 of the end panel 128, respectively.

Pluralities of top border suction cups 142, edge suction cups 144 and 146, and cut out border suction cups 148 of surface 150 of the side panel 124 facing wall 152 of the bath enclosure 112 are incorporated onto the side panel 124 for adherence to the wall 152 upon installation. Pluralities of top border suction cups 154, strip suction cups 156, side border suction cups 157, and cut out border suction cups 158 of surface 160 of the end panel 128 facing wall 162 of the bath enclosure 112 are incorporated onto the end panel 128 for adherence to the wall 162 upon installation. Corner edges 164 and 166 are adhesively coated for adherence to confrontingly mating surfaces 168 of the side panel 24 facing away from the wall 152. Pluralities of top border suction cups 174, strip suction cups 176, and side border suction cups 177 of surface 178 of the end panel 126 facing wall 180 of the bath enclosure 112 are incorporated onto the end panel 126 for adherence to the wall 180 upon installation. Corner edges 182 and 184 are adhesively coated for adherence to confrontingly mating surfaces 186 and 188 of the side panel 124 facing away from the wall 152 and the wall 180.

Figure 8:
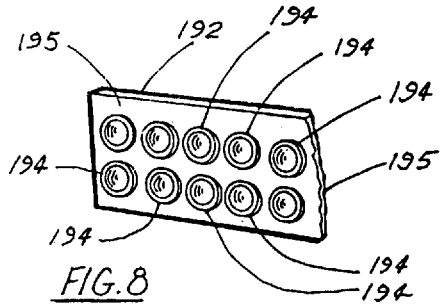
FIG. 8 is a perspective view of a border strip of suction cups for adhering the side panel and the opposing end panels of the disposable bath liner of FIG. 6 to walls of a tub enclosure.
Figure 9:
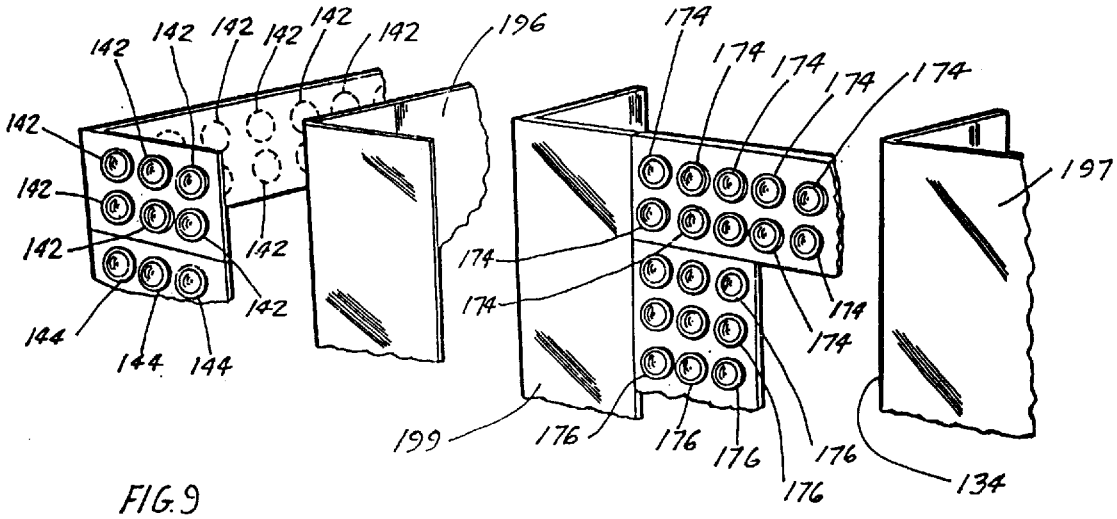
FIG. 9 is a perspective break out view of a corner of the disposable bath liner of FIG. 6.
Figure 10:
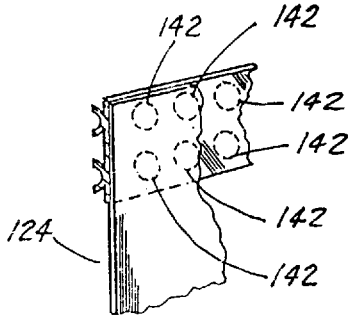
FIG. 10 is a perspective break out view of a section of the side panel of the disposable bath liner of FIG. 6.
Figure 11:
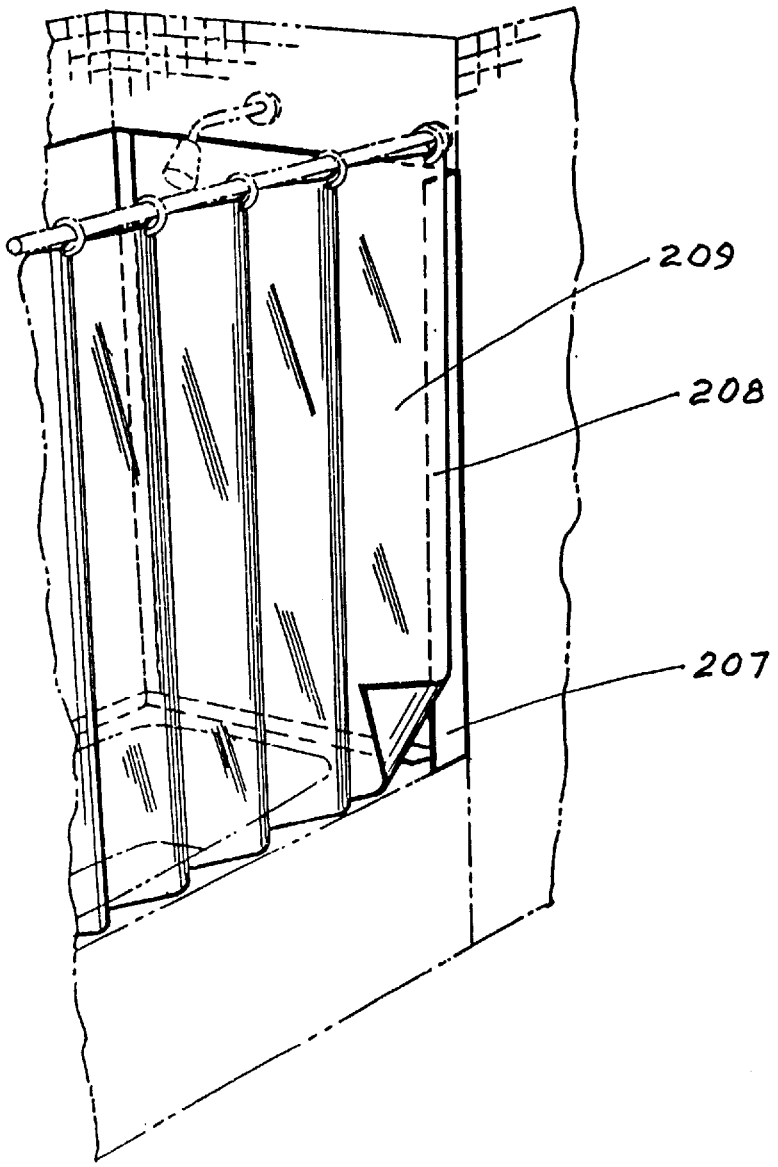
FIG. 11 is a perspective view of an optional shower curtain having a border adhered to a flap of the disposable bath liner of FIG. 6.
Figure 12:
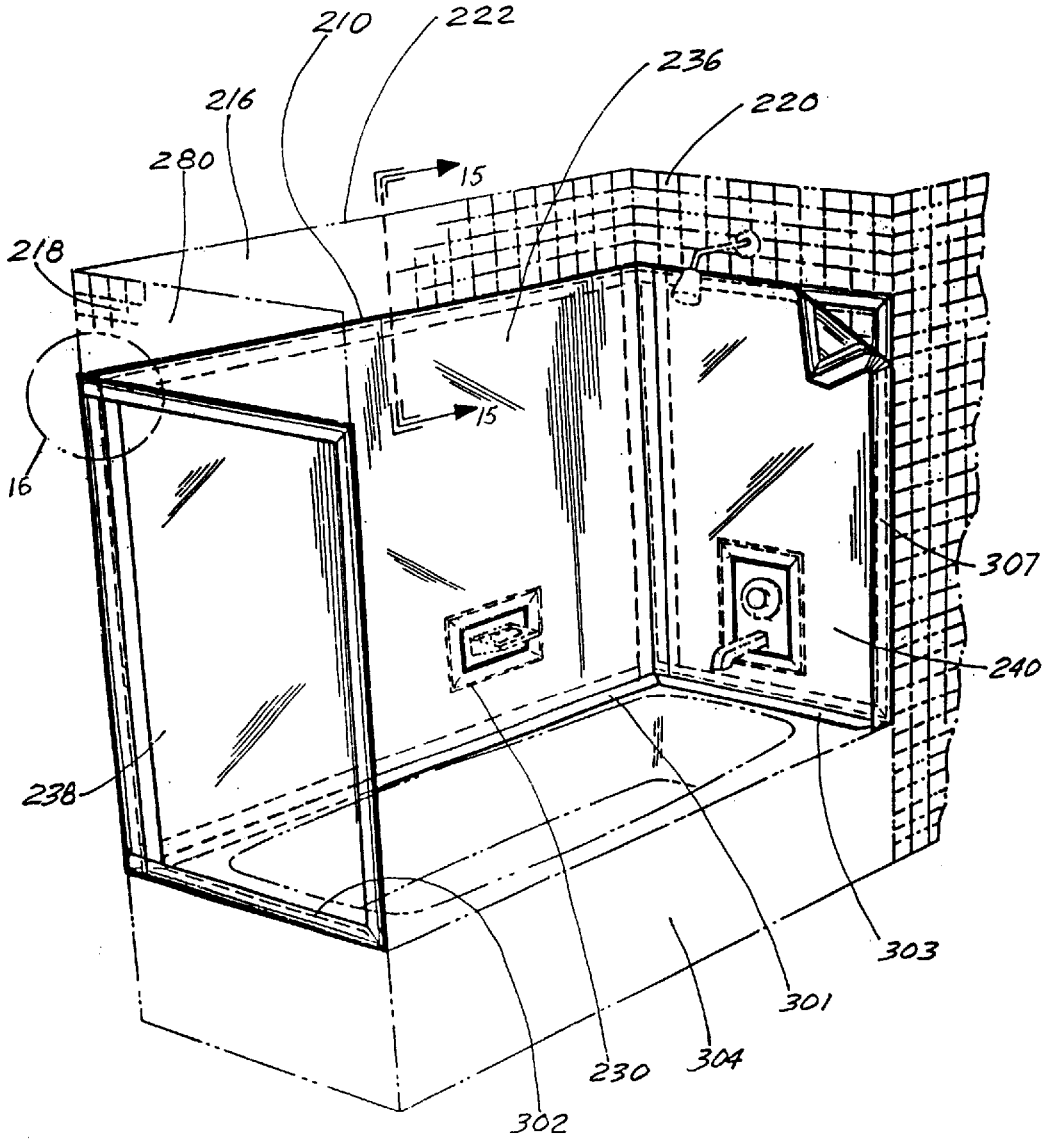
FIG. 12 is a perspective view of an alternate embodiment of a disposable bath liner, constructed in accordance with the present invention.
Figure 13:
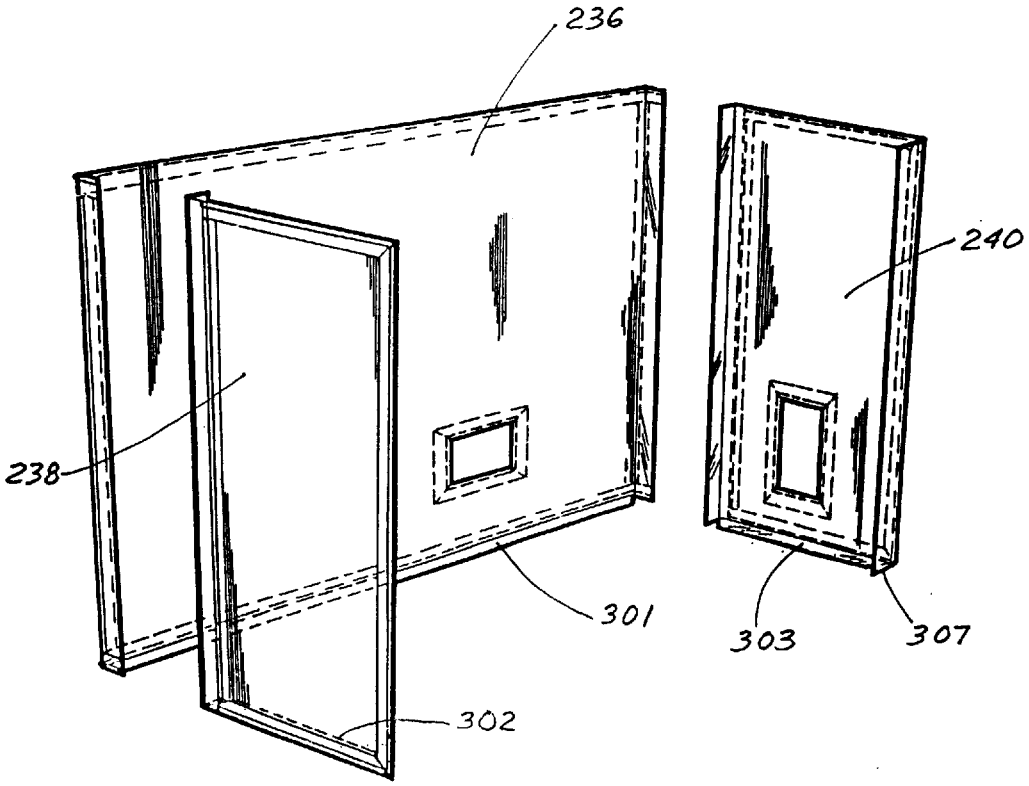
FIG. 13 is a perspective view of a side panel and opposing end panels of the disposable bath liner of FIG. 12.

The top border suction cups 142, the edge suction cups 144 and 146, and the cut out border suction cups 148 of the side panel 124, the border suction cups 154, the strip suction cups 156, and the cut out border suction cups 158 of the end panel 128, and the top border suction cups 174 and the strip suction cups 176 of the end panel 126 may be incorporated onto the side panel 124 and the opposing end panels 126 and 128 or may be alternatively incorporated onto border strips 192, as shown in FIG. 8. The border strips 192 each have a plurality of suction cups 194 mounted thereon and an opposingly mounted adhesive backing 195. The border strips 192 are each cut to lengths to form: the top border suction cups 142, the edge suction cups 144 and 146, and the cut out border suction cups 148 of the side panel 124; the border suction cups 154, the strip suction cups 156, and the cut out border suction cups 158 of the end panel 128; and the top border suction cups 174 and the strip suction cups 176 of the end panel 126, as shown in FIGS. 9 and 10. The border strips 192 are then adhered to blank side panel 196 to form the side panel 124 and opposing blank end panels 197 and 198 (not shown) to form the end panels 126 and 128. Double backed adhesive strips 199 and opposing strips (not shown) are used at the mating end corners 134 and 136 of the side panel 124 with the corners 138 and 140 of the end panels 126 and 128 to adhere the end panels 126 and 128 to the side panel 124.

The adhesives used are water proof and capable of withstanding repeated water use and temperature extremes customarily associated with routing and repeated bath use. Each of the adhesive coatings may be covered with tape for storing, shipping, and prior to installation, for adherence to the respective surfaces at the time of installation. The side panel 124 and the opposing end panels 126 and 128 are of PVC or other suitable flexible material, which may be clear transparent, tinted, colored transparent, translucent, opaque, or patterned material to allow a user personal choice for use and appearance, while protecting the walls 152, 162, and 180 and associated tiles 201, 202, and 203. The border strips 192 are of PVC or other suitable flexible material, which may be clear transparent, tinted, colored transparent, translucent, opaque, or patterned material to allow a user personal choice for use and appearance.

Bottom edges 204, 205, and 206 of the side panel 124 and the end panels 128 and 126, respectively overlap the tub 114. Optional flap 207 is provided on end panel 128 for adherence to border 208 of optional shower curtain 209. The optional flap 207 may be adhesively coated for adherence to the optional shower curtain 209, or the optional flap 207 and the optional shower curtain 209 may have interlocking hook and loop fasteners for adjoining each thereto the other.

Figure 14:
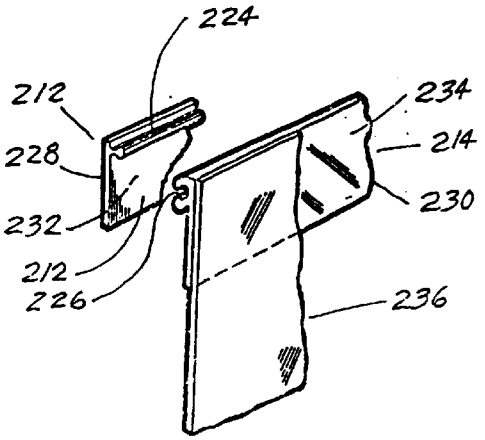
FIG. 14 is a perspective view of a border strip of mating tubular tongue strips and tubular groove strips for adhering the side panel and the opposing end panels of the disposable bath liner of FIG. 12 to walls of the tub enclosure.
Figure 14:
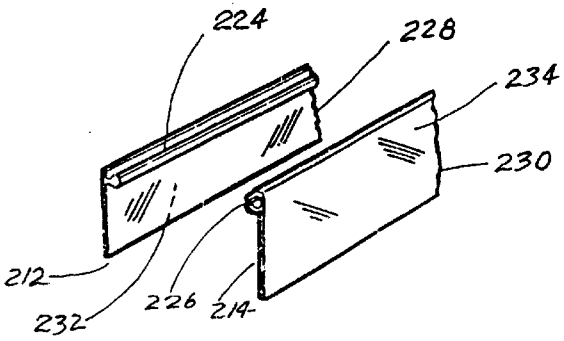
Figure 15:
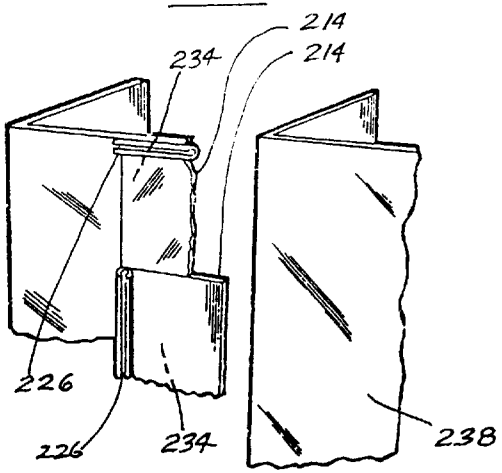
FIG. 15 is a perspective break out view of a section of the side panel of the disposable bath liner of FIG. 12.
Figure 16:
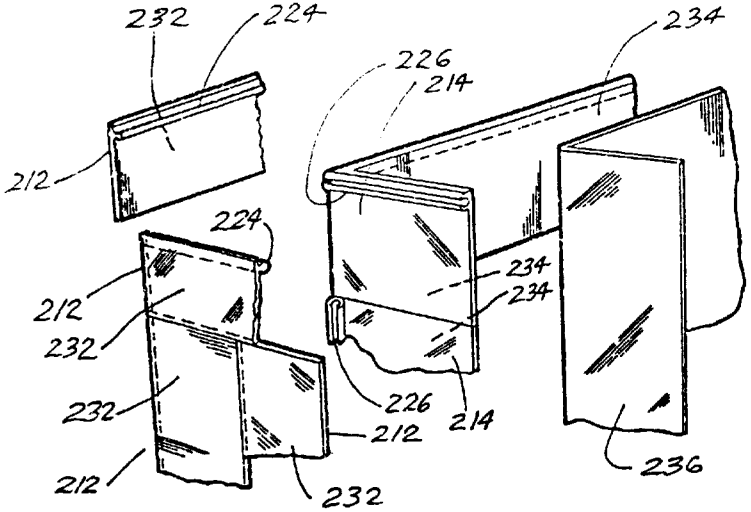
FIG. 16 is a perspective break out view of a corner of the disposable bath liner of FIG. 12.
Figure 17:
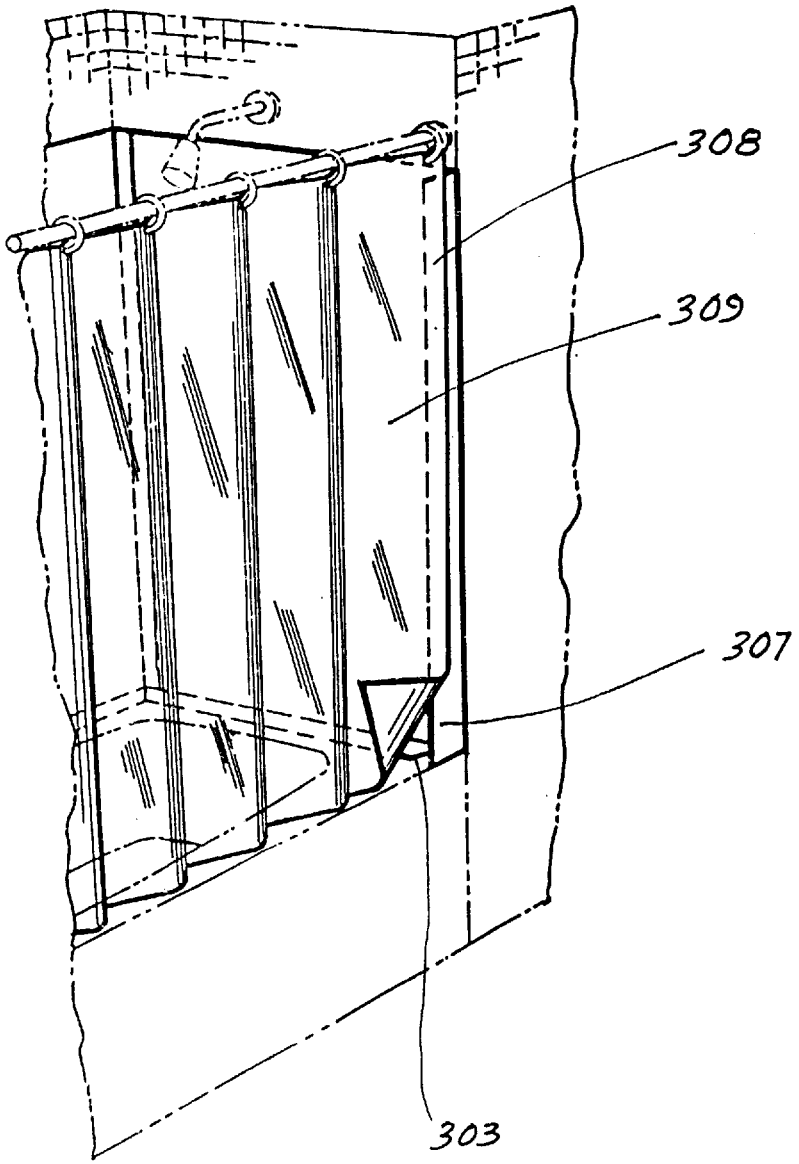
FIG. 17 is a perspective view of an optional shower curtain having a border adhered to a flap of the disposable bath liner of FIG. 6.

An alternate embodiment of a disposable bath liner 210 shown in FIGS. 12–17 is substantially the same as the disposable bath liner 110 of FIGS. 6–11, except that tongue and groove fasteners, i.e. mating resilient flexible tubular tongue strips 212 and resilient flexible tubular groove strips 214, as shown in FIG. 14–16, are used to adhere the disposable bath liner 210 to walls 216, 218, and 220 of bath enclosure 222. The resilient flexible tubular tongue strips 212 and the resilient flexible tubular groove strips 214 are of PVC or other suitable flexible resilient material that allows for semi permanent mating of each to the other. The resilient flexible tubular tongue strips 212 and the resilient flexible tubular groove strips 214 are removably adjoined each to the other by a user pressing and running a finger or other object along the back of the resilient flexible tubular tongue strip 212, while pressing and aligning each to the other, such that the resilient flexible tubular tongue strip 212 matingly adjoins and fits onto the resilient flexible tubular groove strip 214.

The resilient flexible tubular tongue strips 212 and the resilient flexible tubular groove strips 214 are of molded construction with tongue 224 and groove 226 molded onto strips 228 and 230, respectively, each having opposingly mounted adhesive backings 232 and 234 adhered thereto. The resilient flexible tubular groove strips 214 are cut to length and adhered to side panel 236, and opposing end panels 238 and 240. The resilient flexible tubular tongue strips 212 are cut to length and adhered to the walls 216, 218, and 220 of the bath enclosure 222. The side panel 236, and the opposing end panels 238 and 240 with the resilient flexible tubular tongue strips 212 adhered thereto are then adjoined to the resilient flexible tubular groove strips 214 adhered to the walls 216, 218, and 220 of the bath enclosure 222.

The disposable bath liner 210 may also be fabricated with hook and loop fasteners, in place of the that tongue and groove fasteners, to adhere the disposable bath liner 210 to the walls 216, 218, and 220 of the bath enclosure 222 and to adhere the side panel 236 to the end panels 238 and 240, respectively.

Bottom edges 301, 302, and 303 of the side panel 236 and the end panels 238 and 240, respectively overlap tub 304. Optional flap 307 is provided on the end panel 240 for adherence to border 308 of optional shower curtain 309. The optional flap 307 may be adhesively coated for adherence to the optional shower curtain 309, or the optional flap 307 and the optional shower curtain 309 may have interlocking hook and loop fasteners for adjoining each thereto the other.

Figure 18:
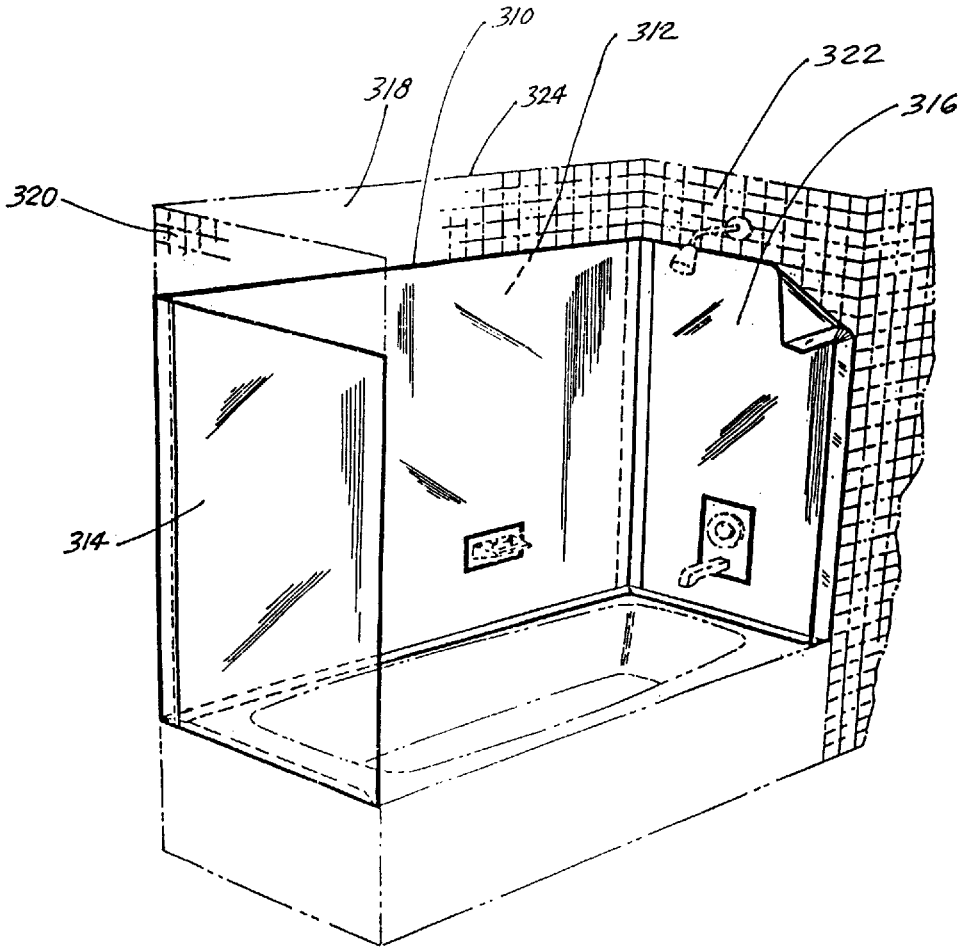
FIG. 18 is a perspective view of an alternate embodiment of a disposable bath liner, constructed in accordance with the present invention.
Figure 19:
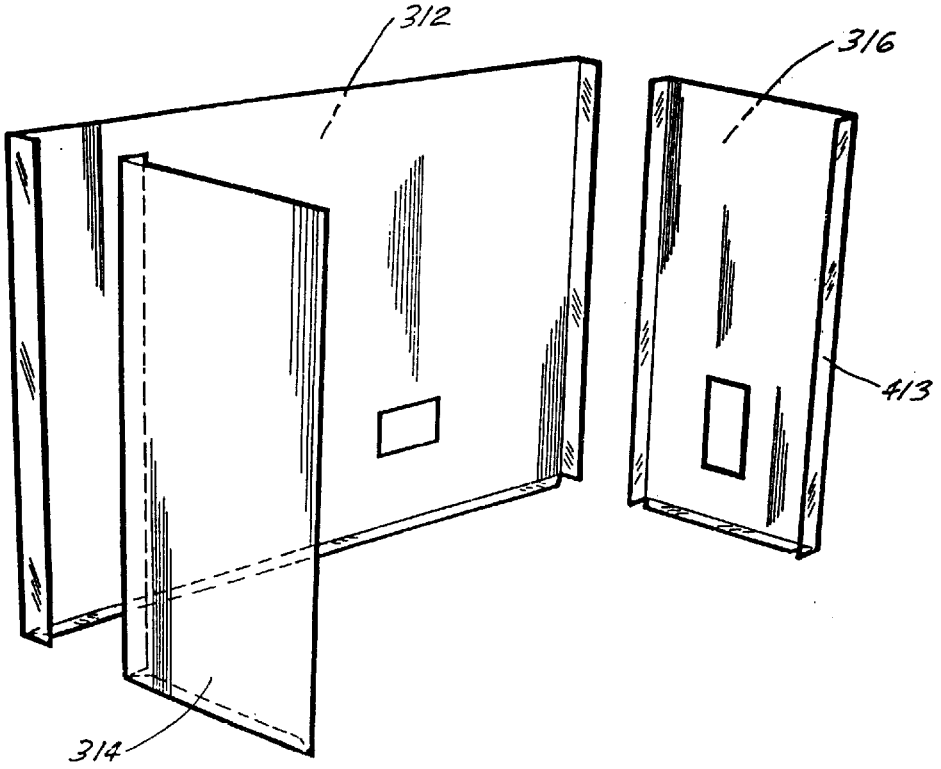
FIG. 19 is a perspective view of a side panel and opposing end panels of the disposable bath liner of FIG. 18.
Figure 20:
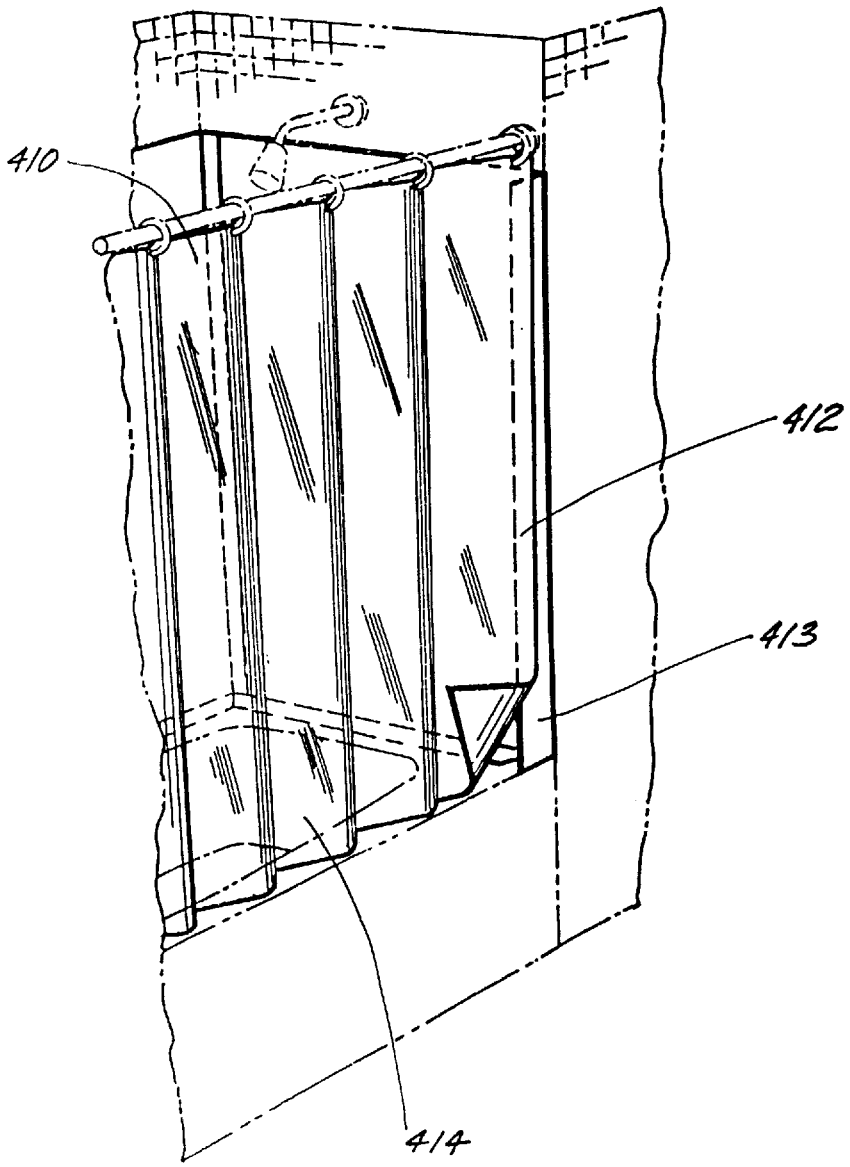
FIG. 20 is a perspective view of an optional shower curtain having a border adhered to a flap of the disposable bath liner of FIG. 18.

An alternate embodiment of a disposable bath liner 310 shown in FIGS. 18–20 is substantially the same as the disposable bath liner 10 of FIGS. 1–5, except that side panel surfaces 312 and opposing end panel surfaces 314 and 316 are coated with adhesive for adherence to walls 318, 320, and 322 of bath enclosure 324.

An optional shower curtain liner 410 for use with the disposable bath liner 310 having an adhesive border 412 for adherence to flap 413 of optional shower curtain 414 is shown in FIG. 20.

Figure 21:
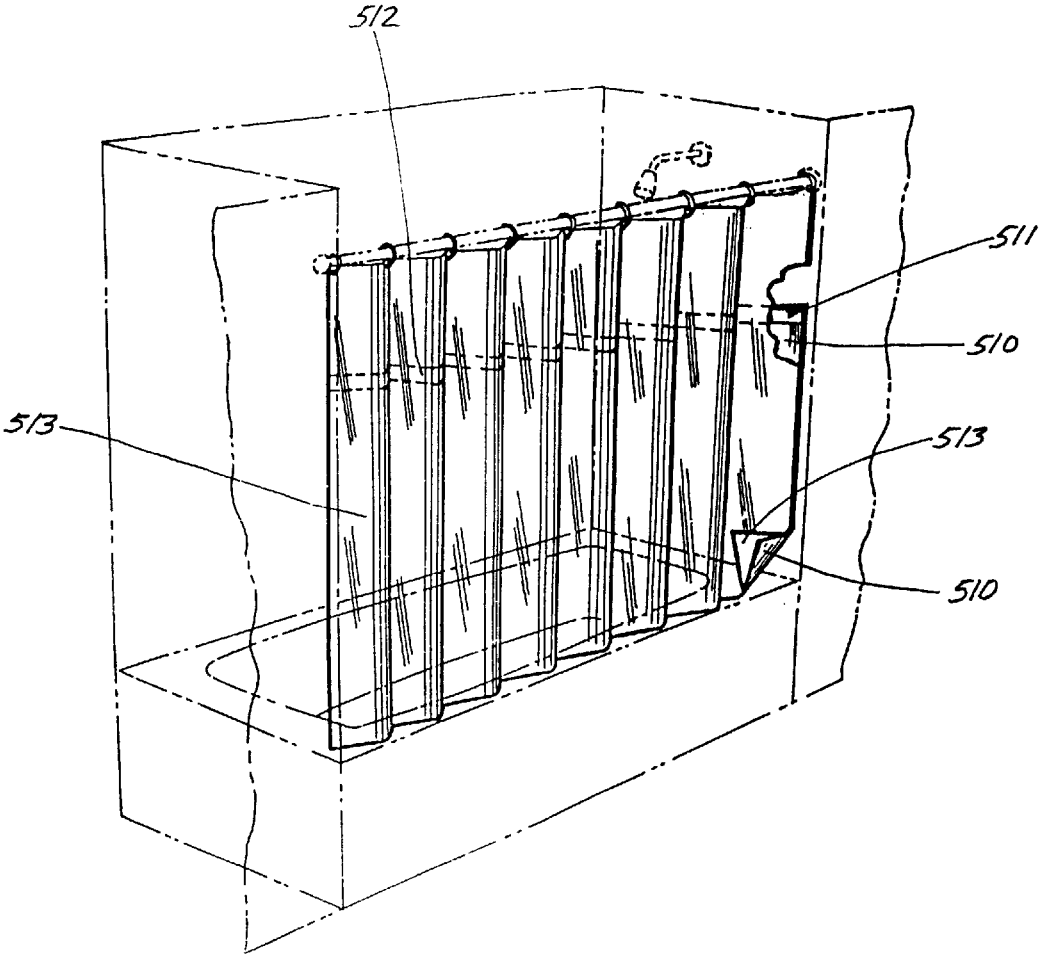
FIG. 21 is a perspective view of an optional shower curtain liner for use with the embodiments shown in FIGS. 1–20.

FIG. 21 shows an optional shower curtain liner 510, which may be used with the embodiments shown in FIGS. 1–20, having an adhesive backing strip 511 for adherence to portion 512 of shower curtain 513.

Although the present invention has been described in considerable detail with reference to certain preferred versions thereof, other versions are possible. Therefore, the spirit and scope of the appended claims should not be limited to the description of the preferred versions contained herein.

What is claimed is:

1. A disposable bath liner, comprising:

a side panel and opposing end panels for covering and protecting a side wall and opposing end walls of a bath enclosure, respectively, wherein further said side wall and said opposing end walls define opposing wall corners;

at least portions of said side panel and at least portions of said opposing end panels having means for adhering said portions of said side panel and said portions of said opposing end panels to said side wall and said opposing end walls, respectively;

said side panel having opposing edge corners at said opposing wall corners;

said end panels having opposing edge corners at said opposing wall corners; one said end panel having an edge corner at one said wall corner and said other end panel having an edge corner at said other opposing wall corner;

one said opposing edge corner of said side panel for mating with one said edge corner of one said end panel at one said wall corner and said other opposing edge corner of said side panel for mating with said edge corner of said other end panel at said other wall corner;

said side panel opposing edge corners and each said end panel edge corner having adhesive means for adhering each said end panel edge corner to said respective opposing side panel edge corner, one to the other; said side panel having a cut out for a bath fixture to fit therethrough; and at least one said opposing end panel having a cut out for another bath fixture to fit therethrough.

2. The disposable bath liner according to claim 1, wherein said adherence means for adhering said portions of said side panel and said portions of said opposing end panels to said side wall and said opposing end walls, respectively, comprises a plurality of suction cups adjoined to said side panel portions and a plurality of suction cups adjoined to each said end panel portions.

3. The disposable bath liner according to claim 1, wherein said adherence means for adhering said portions of said side panel and said portions of said opposing end panels to said side wall and said opposing end walls, respectively, comprises fasteners adjoined to said side panel portions and mating fasteners adapted to be adjoined to said side wall for mating with said side panel fasteners, fasteners adjoined to each said end panel portions, and mating fasteners adapted to be adjoined to each said opposing end wall for mating with said respective end panel fasteners.

4. The disposable bath liner according to claim 3, wherein said fasteners and said mating fasteners are hook and loop fasteners.

5. The disposable bath liner according to claim 3, wherein said fasteners and said mating fasteners are tongue and groove fasteners.

6. The disposable bath liner according to claim 1, wherein said adherence means for adhering said portions of said side panel and said portions of said opposing end panels to said side wall and said opposing end walls, respectively, comprises strips having fasteners adjoined to said side panel portions and mating fasteners adapted to be adjoined to said side wall for mating with said side panel fasteners, strips having fasteners adjoined to each said end panel portions, and mating fasteners adapted to be adjoined to each said opposing end wall for mating with said respective end panel fasteners.

7. The disposable bath liner according to claim 1, wherein said adherence means for adhering said portions of said side panel and said portions of said opposing end panels to said side wall and said opposing end walls, respectively, comprises adhesive coatings on said side panel portions and adhesive coatings on each said end panel portions.

8. The disposable bath liner according to claim 7, wherein said portions of said side panel and said portions of said opposing end panels comprise said entire side panel and said entire opposing end panels, respectively.

9. The disposable bath line according to claim 1, wherein said side panel and said opposing end panels are of a flexible material.

10. The disposable bath line according to claim 1, wherein said side panel and said opposing end panels are selected from the group consisting of transparent, translucent, opaque, tinted, and patterned materials.

11. The disposable bath line according to claim 1, wherein said side panel and said opposing end panels are of a material having ornamental designs on said material.

12. The disposable bath liner according to claim 1, wherein said side panel and said opposing end panels are of PVC.

13. The disposable bath liner according to claim 1, wherein said adhesive means comprises a water proof adhesive coating.

14. The disposable bath liner according to claim 1, wherein said adhesive means comprises a temperature resistant water proof adhesive coating.

15. The disposable bath liner according to claim 1, wherein said adherence means for adhering said portions of said side panel and said portions of said opposing end panels to said side wall and said opposing end walls, respectively, comprises water proof adhesive coatings on said side panel portions and water proof adhesive coatings on each said end panel portions.

16. The disposable bath liner according to claim 1, wherein said at least portions of said side panel and said at least portions of said opposing end panels having means for adhering said portions of said side panel and said portions of said opposing end panels to said side wall and said opposing end walls, respectively are top borders of said side panel and said end panels.

17. The disposable bath liner according to claim 1, wherein said at least portions of said side panel and said at least portions of said opposing end panels having means for adhering said portions of said side panel and said portions of said opposing end panels to said side wall and said opposing end walls, respectively are top borders and side borders of said side panel and said end panels.

18. The disposable bath liner according to claim 1, wherein further said disposable bath liner further comprises a shower curtain, one said end panel has a side flap, and means for adhering a side portion of said shower curtain thereto said end panel side flap.

19. The disposable bath liner according to claim 18, wherein said adherence means is an adhesive coating.

20. The disposable bath liner according to claim 18, wherein said adherence means are mating hook and loop fasteners on said side shower curtain portion and said end panel side flap.

* * * * *